US008764516B2

(12) United States Patent
Nelson

(10) Patent No.: US 8,764,516 B2
(45) Date of Patent: Jul. 1, 2014

(54) HAND HELD MACHINE FOR GRINDING AND LIKE OPERATIONS

(75) Inventor: Anders Urban Nelson, Alvsjo (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 268 days.

(21) Appl. No.: 13/141,461

(22) PCT Filed: Dec. 18, 2009

(86) PCT No.: PCT/SE2009/000527

§ 371 (c)(1),
(2), (4) Date: Jun. 22, 2011

(87) PCT Pub. No.: WO2010/074626

PCT Pub. Date: Jul. 1, 2010

(65) Prior Publication Data

US 2011/0263185 A1 Oct. 27, 2011

(30) Foreign Application Priority Data

Dec. 22, 2008 (SE) ..... 0802638

(51) Int. Cl.
*B24B 23/04* (2006.01)
*B24B 23/02* (2006.01)

(52) U.S. Cl.
USPC ..... 451/358; 384/196

(58) Field of Classification Search
USPC ..... 384/196; 451/358
IPC ..... B24B 23/02,23/04
See application file for complete search history.

(56) References Cited

U.S. PATENT DOCUMENTS

| | | | | |
|---|---|---|---|---|
| 2,956,450 | A | 10/1960 | Yule | |
| 3,858,362 | A | 1/1975 | Welsch | |
| 4,268,233 | A * | 5/1981 | Fernstrom | 418/270 |
| 6,537,044 | B2 * | 3/2003 | Chang et al. | 418/55.4 |
| 2008/0118321 | A1 * | 5/2008 | Sugita et al. | 409/231 |
| 2009/0137193 | A1 * | 5/2009 | Iwata et al. | 451/95 |

FOREIGN PATENT DOCUMENTS

| | | | |
|---|---|---|---|
| EP | 0 005 686 | A1 | 11/1979 |
| EP | 1 714 748 | A2 | 10/2006 |
| GB | 1198276 | | 7/1970 |

OTHER PUBLICATIONS

International Search Report dated Apr. 12, 2010 (in English) in counterpart International Application No. PCT/SE2009/000527.

* cited by examiner

*Primary Examiner* — Joseph J Hail
*Assistant Examiner* — Marc Carlson
(74) *Attorney, Agent, or Firm* — Holtz Holtz Goodman & Chick PC

(57) ABSTRACT

A hand held machine for grinding and like operations, includes a housing, a motor mounted in the housing and which rotates an axle connected to a tool carrying mechanism, and a front bearing arrangement provided between the housing and the axle, including a front bearing, and a vibration insulator which is resilient to radial displacement of the axle. The vibration insulator includes at least one resilient element located between the housing and the front bearing. The machine further includes an adjustment mechanism interacting with the at least one resilient element for adjustment of the resilience of the resilient element.

20 Claims, 7 Drawing Sheets

HAND HELD MACHINE FOR GRINDING AND LIKE OPERATIONS

This application is a U.S. National Phase Application under 35 USC 371 of International Application PCT/SE/2009/000527 filed Dec. 18, 2009.

TECHNICAL FIELD

The present invention relates to a hand held machine intended for grinding and like operations, in particular to a machine having adjustable vibration insulating means.

BACKGROUND OF THE INVENTION

Machine tools such as die grinders are available in rigid or flexible design. In a rigid design the axle carrying the spindle for attachment of the grinding burr is rigidly mounted in the tool, whereas in a flexible design, this axle is flexibly mounted, by means of a resilient element. Both designs have advantages, the rigidly mounted spindle carrying axle is useful for example when very high exactness is required in the grinding process, and the flexible mounting of the spindle carrying axle is ergonomic since vibrations generated during the grinding process are not transferred to the tool housing and thus not to the hand and arm of the user. An example of a die grinder of flexible design is disclosed in EP0005686A1.

Machine tools for grinding and the like are rather expensive and space requiring. It would be advantageous if all situations, in which each tool design is needed, could be handled without the need of having two different tools available.

SUMMARY OF THE INVENTION

The present invention relates to a hand held machine for grinding and like operations, comprising a housing, a motor mounted in the housing and rotating an axle connected to a tool carrying means; and a front bearing arrangement between the housing and said axle, including a front bearing, and a vibration insulating means which is resilient to radial displacement of the axle. Said vibration insulating means comprises at least one resilient element located between the housing and the front bearing, and the machine comprises adjustment means interacting with the at least one resilient element for adjustment of the resilience thereof. By adjustment of the resilience of the resilient element of the vibration insulating means, the machine can be adjusted from a flexible vibration dampening holding of the axle in relation to the housing and a rigid holding of the axle in relation to the housing, thereby eliminating the need of having two different machines at hand.

The vibration insulating means may be contained in a spacing between the housing and the front bearing, which spacing has an adjustable volume, thereby allowing adjustable compression of said at least one resilient element, and accordingly allowing resilience of the resilient element to be adjusted, thereby enabling efficient adjustment of the resilience. The spacing may have a maximum volume and a minimum volume, said maximum volume allowing the resilient element to be contained in the spacing without being compressed and said minimum volume compressing the resilient element to such a degree where it is substantially no longer resilient. The volume of said spacing is continuously adjustable, so that the vibration dampening can be adjusted to a degree desired by the user of the machine.

The spacing is defined between the housing the front bearing and the adjustment means, said adjustment means being arranged adjacent to the resilient element, and being movable in order to achieve adjustment of the spacing volume, and thereby achieving adjustment of the resilience of the resilient element. The adjustment means comprises an actuator for actuating a compressing element provided in the housing accessible from the outside of the housing.

The actuator comprises a rotatable ring, which can be rotated between a first and a second position, wherein said actuator interacts with the compressing element, so that in the first position the compressing element is retracted from the resilient element, and in the second position the compressing element is advanced towards the resilient element, thus obtaining in the first position a flexible holding of the axle in relation to the housing, and in the second position a rigid holding of the axle in relation to the housing.

The actuator may comprise a cam having an edge with a cam curvature, which cam curvature interacts with a cam follower, which causes a displacement of the compressing element so as to increase or decrease the volume of said spacing.

Alternatively, the axial movement of the compressing element is achieved by rotating a member provided with threads which is engaged by threads on the housing.

DETAILED DESCRIPTION

Hand held machines for grinding are available in both a short and in an extended design. In an extended machine, an extension, which is a part of the housing, is connected to the main body of the housing, and an extended axle is flexibly connected to the axle driven by the motor. The present invention mainly relates to machines driven by compressed air. However, such machines may also be driven by an electrical motor.

The hand held machine of the present invention is provided with a vibration insulating means at the front bearing arrangement, for absorbing radial displacements due to spindle vibrations. The hand held machine can be adjusted from a flexible vibration dampening position to a rigid position in which vibrations are not being dampened. This is done by adjustment of the resilience of a resilient element which is a part of a front bearing arrangement located between the rotating axle of the machine and the housing.

The front bearing arrangement is located in the vicinity of the collet holder, which holds nut and collet for holding a grinding tool. In the case of a short machine the front bearing arrangement, which includes the adjustable vibration dampening means is arranged at the front end of the motor, i.e. between the motor and the collet holder.

In the case of an extended machine, the front bearing arrangement, which includes the adjustable vibration dampening means is arranged at the front end of the extension. Such an extended machine also has a bearing arrangement close to the motor.

The adjustment of the resilience of the resilient element is achieved by the application of a variable compressing force to the resilient element, so that the resilience of the resilient element is at a maximum when the resilient element is unloaded, at a minimum when the applied force is at its maximum. The resilient element could e.g. be a ring of a resilient material arranged around the periphery a bearing, or discrete elastic parts arranged around said periphery. Alternatively, the resilient element could be a metal spring.

The force is applied to the resilient element by moving a compressing element towards the resilient element. In practice this can be done by arranging the resilient element in a confined spacing, between component parts of the machine, which spacing is large enough to contain the resilient element in an unloaded state, i.e. in the state in which it is most resilient. At least one of the component parts that make up the spacing is moveable towards the centre of the spacing, so that the volume of the spacing decreases when this component part is moved forwards. Thus, when the volume of the spacing is decreased, a compressing force is exerted on the resilient element by the moveable part, which acts as a compressing element, and accordingly the resilience of the resilient element is decreased as the compressing element is moved forwards. The compressing element can continue to move forward and the resilience continuously decreases until the resilient element is substantially non-resilient, and the compressing element cannot move any further. Likewise the resilience of the resilient element increases as the compressing element is moved backwards away from the centre of the spacing. Hence, the resilience is continuously adjustable.

The spacing, which can be made up by parts of the housing, the front bearing arrangement and the compressing element, and in which the resilient element is contained thus has a maximum volume and a minimum volume. At the maximum volume the resilient element can be contained in the spacing without being compressed, and at the minimum volume the resilient element is compressed to such a degree where it is substantially no longer resilient. If desired, the maximum volume can be chosen such that the resilient element is somewhat compressed (i.e. not at its absolute maximum resilience) and/or the minimum volume can be chosen such that the minimum resilience of the resilient element is somewhat higher than substantially non-resilient.

An actuator for actuating said compressing element can be provided in the housing, accessible from the outside of the housing, which enables the user to easily actuate the compressing element. The actuator may be a rotatable ring, which can be moved between two end positions, flexible and rigid, respectively.

The movement of the compressing element can be performed in a number of ways. For example, the actuator may comprise a cam having an edge with a curvature, which cam curvature interacts with a cam follower, thereby causing a displacement of the compressing element so as to increase or decrease the volume of said spacing. The actuator comprises a rotatable ring, which can be rotated between a first and a second position, and the cam is arranged on the inner side of the rotatable ring, so that in the first position the compressing element is retracted from the resilient element, and in the second position the compressing element is advanced towards the resilient element, thus obtaining in the first position a flexible holding of the axle in relation to the housing, and in the second position a rigid holding of the axle in relation to the housing. The compressing element may be an integrated part of the cam follower. In case the compressing element is a separate component, such as a conical ring, the rearward movement of thereof is a result of the combination of retraction of the cam follower and the resilience of the resilient element, as the resilient element will return to its original unloaded shape when a compressing force is no longer applied on it, thus forcing the compressing member rearwards.

Alternatively, the actuator may comprise a ring which affects a pin that is connected to the compressing element, which is engaged with the housing by a threaded connection. The invention is not limited to a certain way of accomplishing the variable compression but more generally how to adjust spindle stiffness in a wider sense. Various ways to transfer a rotational movement into an axial movement are well known, e.g. the thread can be omitted and the axial movement induced by giving the groove in the housing a certain slope which forces a manoeuvre pin to travel axially while the adjustment ring is being rotated.

The manner of achieving the movement of the compressing element is not limited to either of the machine designs mentioned above, but can be used in both short and extended machines.

BRIEF DESCRIPTION OF THE DRAWINGS

The invention will now be described by means of the appended drawings, which are intended to serve as an illustration only.

FIG. 3*a* is an exploded view;

DESCRIPTION OF PREFERRED EMBODIMENTS

Figure 1:
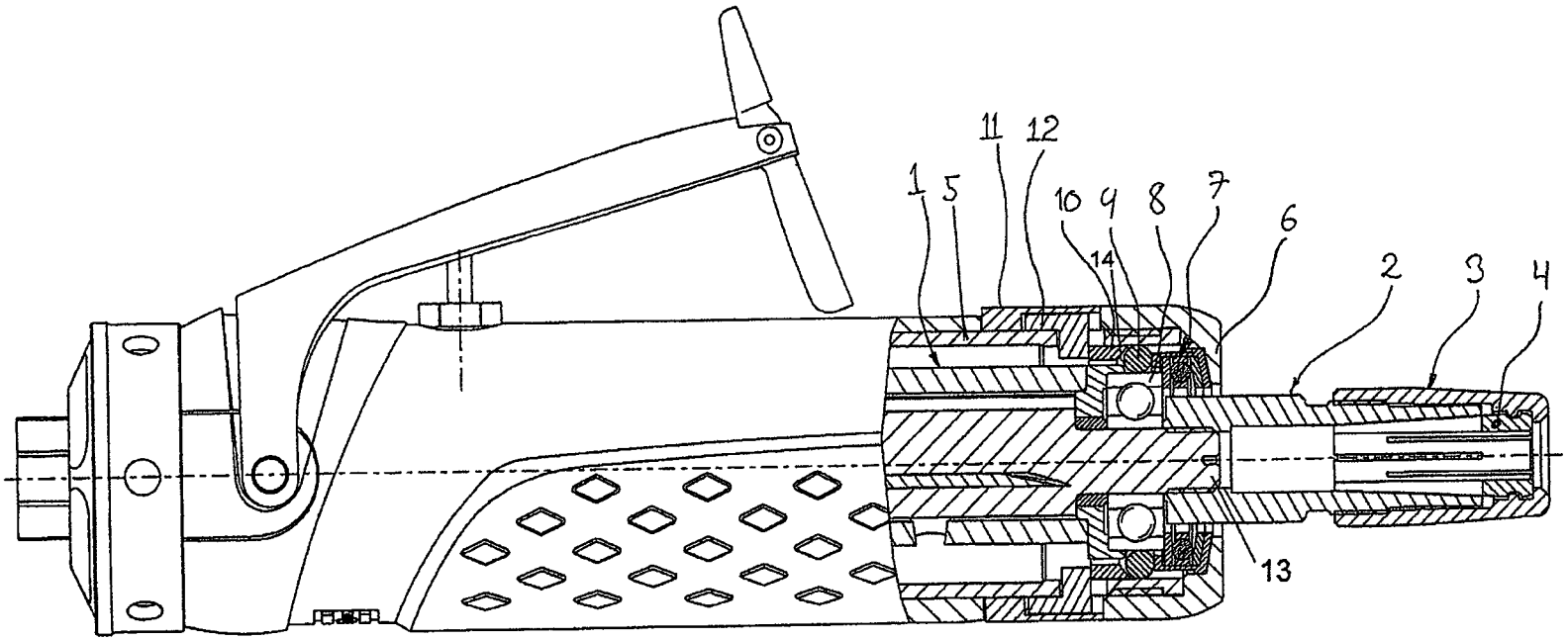
FIG. 1 is a partially cross-sectional view of a grinding machine of short design, in which no compressing force is applied on the resilient element.

FIGS. 1-4 show a hand held machine of short design, which comprises a pneumatic motor 1 enclosed by a housing 5, which drives a rotating axle 13. The forward end of the rotating axle is connected to a collet holder 2 holding a nut 3 and a collet 4, for detachable fastening of a grinding burr.

At the forward end of the motor 1, inside the housing 5, is provided a front bearing 8, between the rotating axle 13 and the stationary machine housing 5. A resilient element 9 is arranged on the outer periphery of the bearing 8. In this case the resilient element 9 is an elastic O-ring, but it could alternatively be any suitable resilient structure. The resilient element 9 is a part of the vibration insulating means provided in the machine, and is arranged to absorb radial vibrations, and to prevent such vibrations from reaching the machine housing 5 and the hand and arm of the user. A resilient ring 7 is provided in front of the bearing 8 in order to allow axial forces to be transmitted without limiting radial movements.

The resilient element 8 is located inside a spacing 14, which is made up by the outer peripheral surface of the bearing 8, component parts of the housing 5, and a moveable compressing element 10, which in the shown example is a ring having a conical surface directed towards the resilient element 9. The axial movement of the compressing element 10 is effected by rotation of an actuator ring 11, which includes a cam curvature 21 interacting with a cam follower 12 that in turn interacts with the compressing element 10. The actuator ring 11 encircles the rotating axle 13 and the housing 5 and is rotatable in two directions, between two end positions. When the ring 11 is positioned in a first end position, the compressing element 10 is retracted from the resilient element 9, which allows full flexibility of the resilient element 9 and thus full vibration insulation. When the ring 11 is positioned in a second end position, the compressing element 10 is pushed forward and compressing the resilient element 9 to such a degree that it is substantially non-resilient, thus resulting in a rigid holding of the bearing 8.

Figure 2:
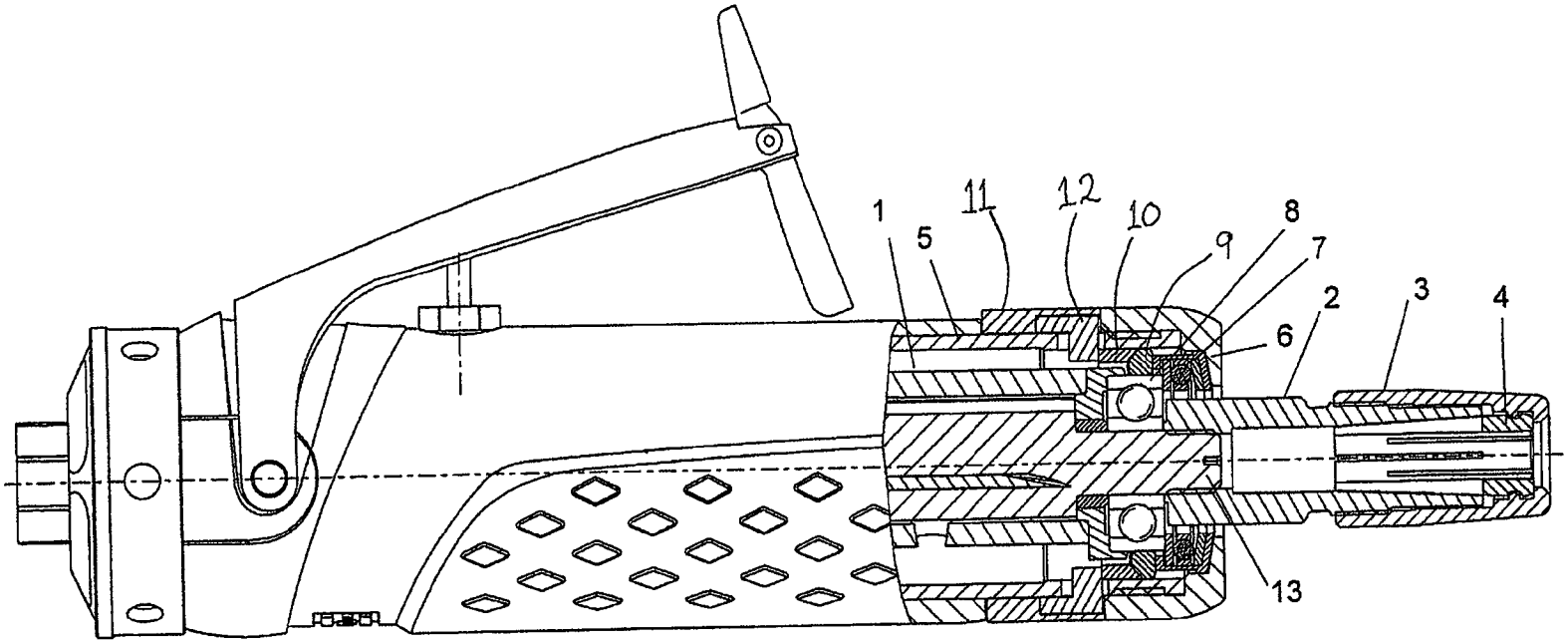
FIG. 2 is a partially cross-sectional view of the grinding machine of FIG. 1, in which a compressing force is applied on the resilient element.
Figures 3A, 3B:
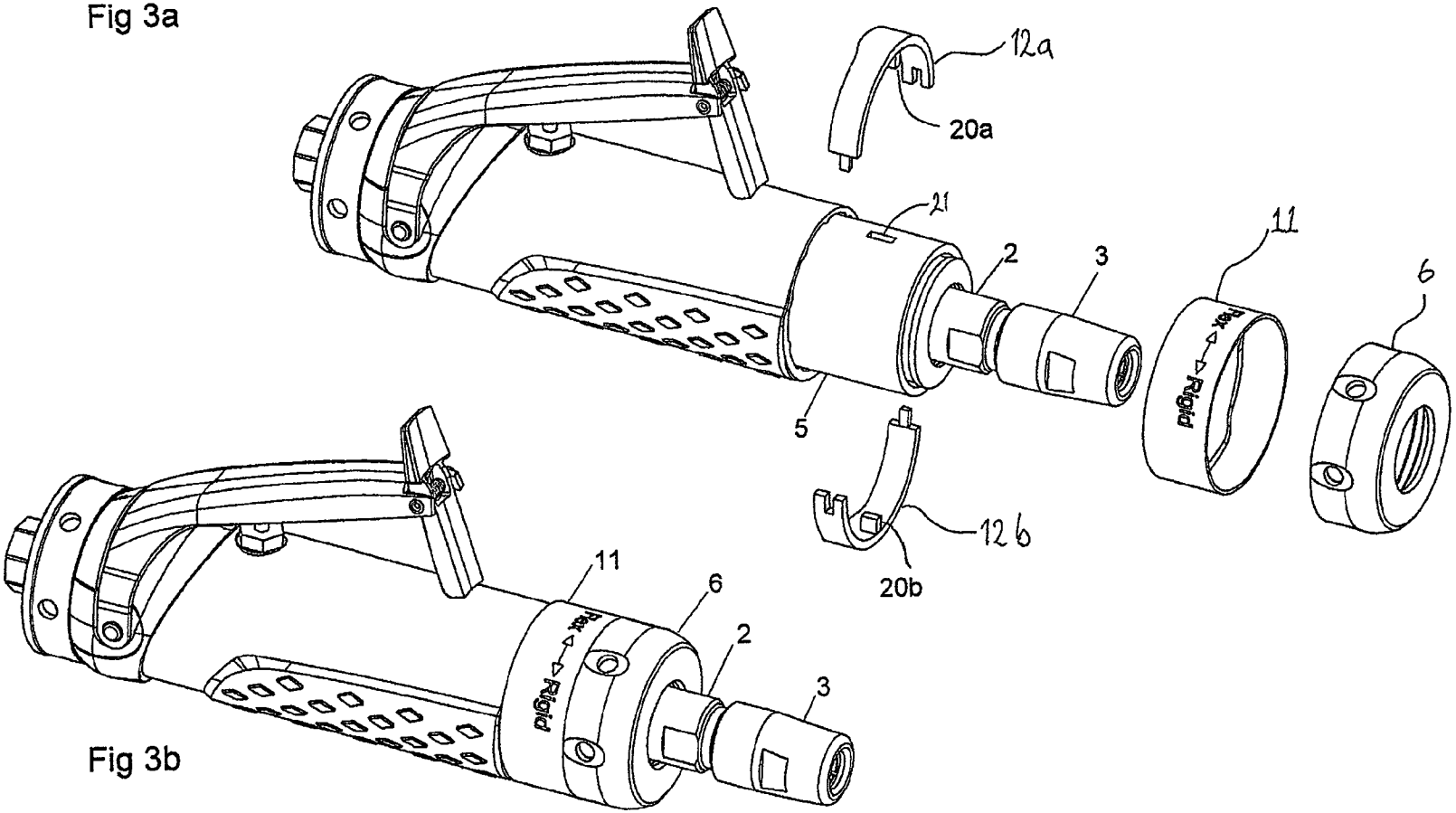
FIG. 3*a* and FIG. 3*b* are perspective side views of the machine of FIG. 1, where
Figure 4:
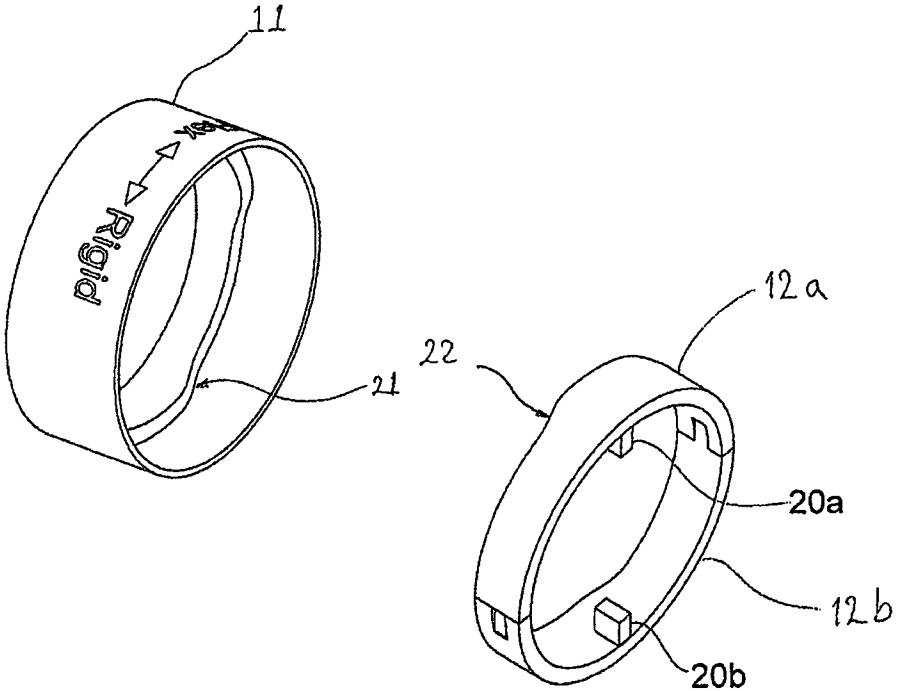
FIG. 4 is an exploded side view of the actuator ring and its interacting cam follower, of the machine of FIG. 1.

In FIG. 1 the compressing element 10 is retracted from the resilient element 9, and no compressing force is thus applied on the resilient element 8. In FIG. 2 the compressing element 10 is in its most forward position and thus applies a compressing force on the resilient element 9. FIGS. 3 and 4 show the actuator ring 11 in more detail. The ring 11 is provided with a cam curve 21 on its inner side. The cam curve is arranged to interact with the cam follower 12, having a curved surface 22 directed towards the cam curve 21 when mounted in the machine. The cam follower 12 comprises two semicircular parts, 12*a*, 12*b*, which are mounted around the housing 5 of the machine. Each of the semicircular cam follower parts, 12*a*, 12*b* have connecting portions at their ends, so that they are secured in relation to each other when the actuator ring 11 has been brought in a position where it encloses the cam follower 12. The cam follower 12 comprises protruding pins 20*a*, 20*b*, which are directed towards the axle 13 of the machine, when mounted. These pins 20*a*, 20*b* engage with slots 21 in the housing 5, whereby they can come in contact with, and interact with, the compressing element 10. At the end of the housing 5 an end ring 6 is attached to the housing 5 in order to prevent the ring 11 to move in a direction parallel to the axle 13.

Figure 6B:
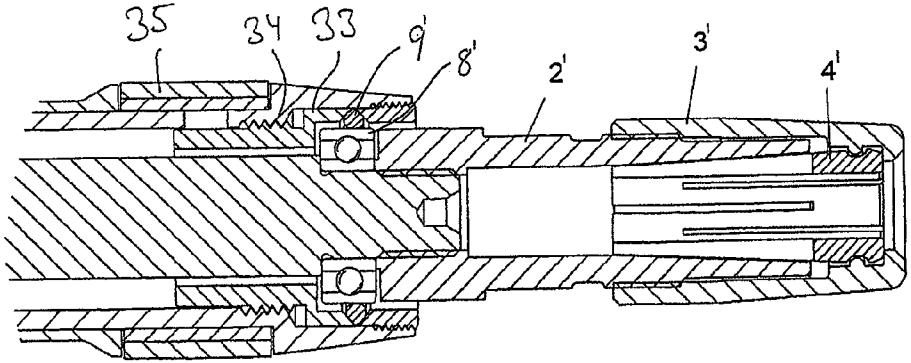
FIG. 6*b* is an enlarged cross-sectional view of the front portion of the machine shown in FIG. 6*a;*
Figure 6A:
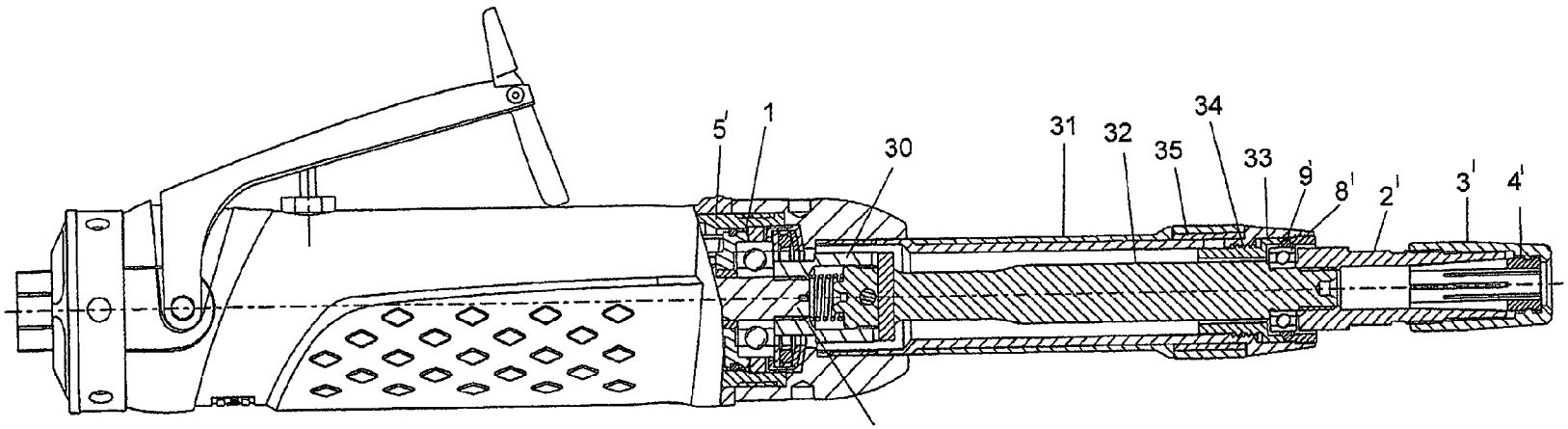
FIG. 6*a* is a partially cross-sectional view of the grinding machine of FIG. 5*a*, in which a compressing force is applied on the resilient element.
Figure 7:
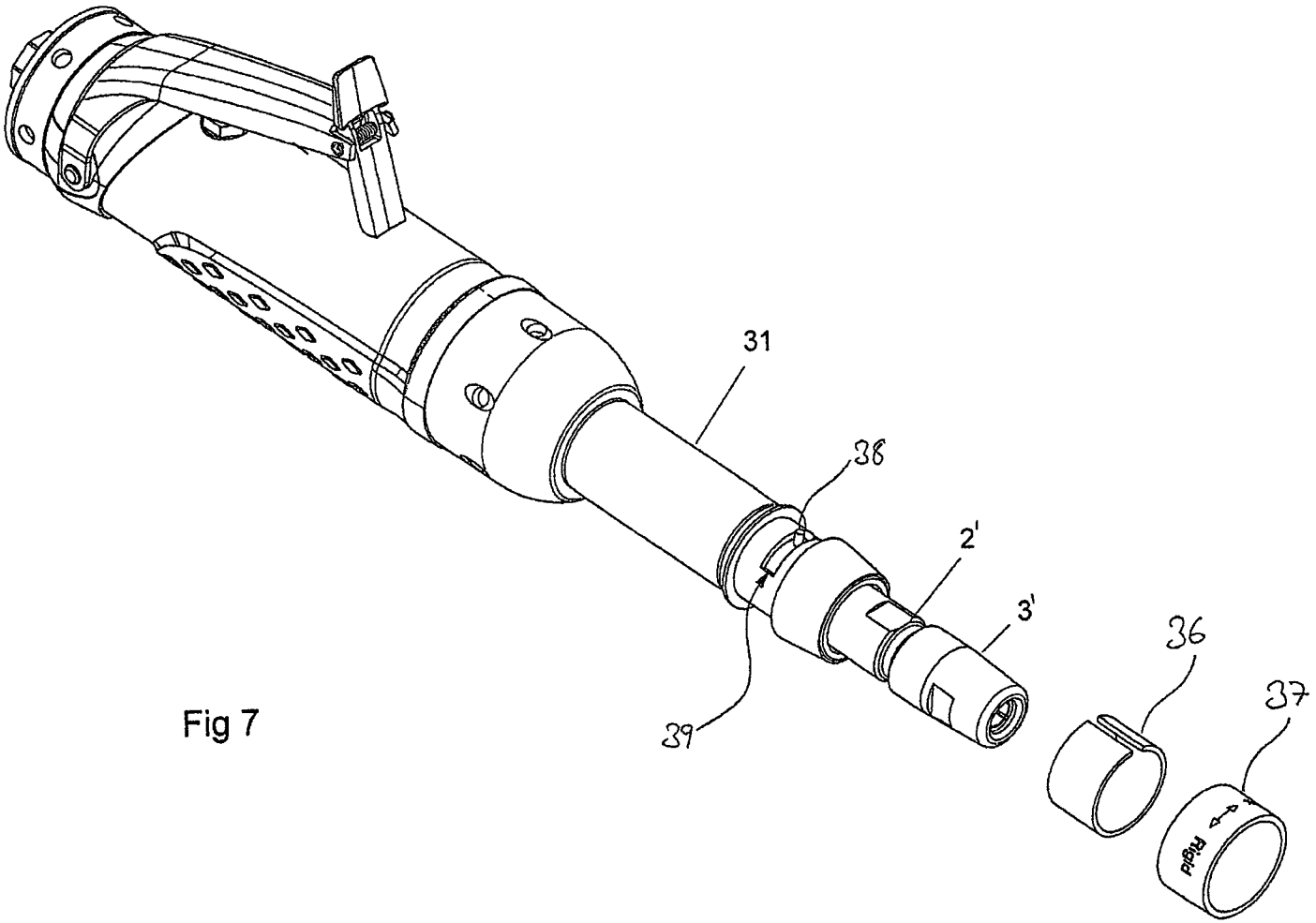
FIG. 7 is an exploded side perspective view of the machine shown in FIG. 5*a*.

FIGS. 5-7 show a hand held machine of extended design, which is similar to the machine of FIGS. 1-4 in many aspects. The extended machine comprises a pneumatic motor 1 enclosed by a housing 5', which drives a rotating axle 13. The housing 5' includes an housing extension 31, which is connected to the main body of the housing 5', and an extended axle 32 is flexibly connected to the axle 13 driven by the motor 1.

A front bearing arrangement, which includes an adjustable vibration dampening means is arranged at the front end of the extension 31. The extended machine also comprises a bearing arrangement close to the motor. The forward end of the extended rotating axle 32 is connected to a collet holder 2' holding a nut 3' and a collet 4', for detachable fastening of a grinding burr.

The front bearing arrangement includes a bearing 8' between the rotating extended axle 32 and the stationary extension 31 of the machine housing 5'.

A resilient element 9' is arranged on the outer periphery of the bearing 8'. The resilient element 9' is contained in a spacing 14 in the machine in the same way, and has the same function, as described above in relation to the machine of short design. The spacing 14 made up by the outer peripheral surface of the bearing 8', component parts of the housing extension 31, and a moveable compressing element 33. The compressing element 33 is engaged to the extended housing 31 by threads 34 that transform a rotary manoeuvre motion to an axial motion. At its rearward section, the compressing element 33 comprises an outwardly protruding pin 38, which protrudes through a slot 39 which is provided along the periphery of the extended housing 31. The actuator 35 comprises an inner sleeve 36 having an opening for receiving the pin 38, and an outer sleeve 37, which holds the inner sleeve 36 in place. The protruding pin 38 is movable from one end of the slot 39 to the other, upon rotation of the actuator 35. Each end of the slot 39 represent an end position for the adjustment of the resilience of the resilient element 9', i.e. at one end the extended axle 32 carrying the tool carrying means for attachment of the grinding burr is rigidly mounted in the tool, whereas at the other end, the extended axle 32 is flexibly mounted.

Figure 5B:
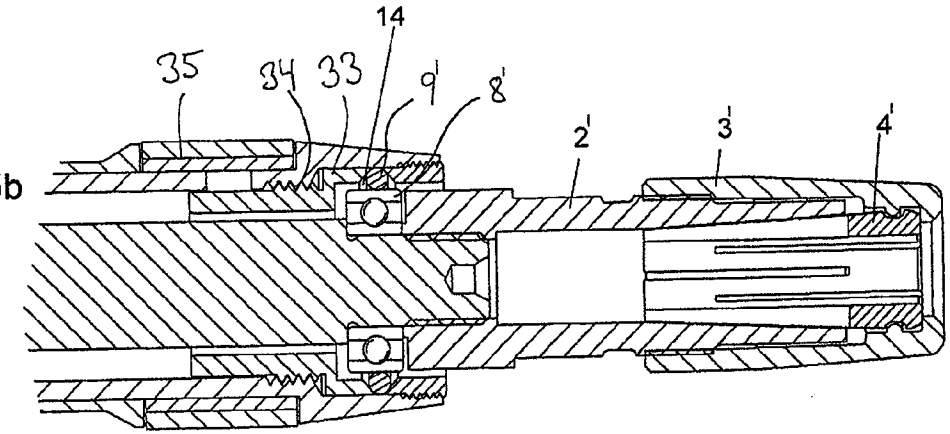
FIG. 5*b* is an enlarged cross-sectional view of the front portion of the machine shown in FIG. 5*a;*
Figure 5A:
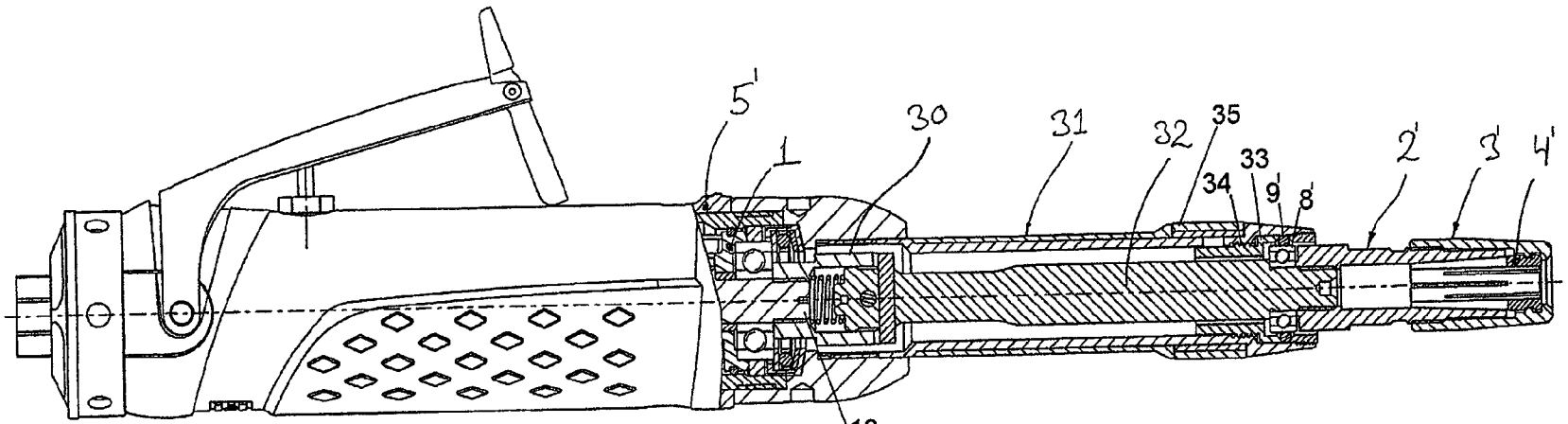
FIG. 5*a* is a partially cross-sectional view of a grinding machine of extended design, in which no compressing force is applied on the resilient element.

In FIGS. 5*a*, 5*b* the compressing element 33 is retracted from the resilient element 9', and no compressing force is thus applied on the resilient element 9'. In FIGS. 6*a*, 6*b* the compressing element 33 is in its most forward position and thus applies a compressing force on the resilient element 9'.

It should be noted that although the manner of achieving a movement of the compressing element 10, 33, as well as the designs of the compressing elements 10, 33 differ somewhat between the embodiments shown in FIGS. 1-4 and 5-7 respectively, all designs and movement arrangements described herein can be used in machines of both short and extended designs, and can be combined as desired.

The invention claimed is:

1. A hand held machine for grinding and like operations, comprising:

a housing;

a motor mounted in the housing and which rotates an axle connected to a tool carrying mechanism;

a front bearing arrangement which is provided between the housing and the axle, and which includes a front bearing and a vibration insulator which is resilient to radial displacement of the axle, wherein the vibration insulator comprises at least one resilient element located between the housing and the front bearing;

an end cap ring to secure the front bearing arrangement inside the housing; and an adjustment mechanism which is captive between the end cap ring and the housing and which interacts with the at least one resilient element to adjust a resilience thereof;

wherein the adjustment mechanism comprises a rotatable actuator which actuates an annular compressing element provided in the housing; and wherein the rotatable actuator is movable to: (i) a first end position where the compressing element is retracted from the resilient element which allows full flexibility of the resilient element to obtain a vibration insulation state of the axle in relation to the housing, and (ii) a second end position where the compressing element is advanced towards and engaging the resilient element compressing the resilient element to such a degree that it is substantially non-resilient to obtain a rigid holding state of the axle in relation to the housing.

2. The hand held machine of claim 1, wherein the vibration insulator is contained in a spacing between the housing and the front bearing, the spacing having an adjustable volume, thereby allowing adjustable compression of said at least one resilient element, and allowing the resilience of the resilient element to be adjusted.

3. The hand held machine of claim 2, wherein the spacing has a maximum volume and a minimum volume, the maximum volume allowing the resilient element to be contained in the spacing without being compressed, and the minimum volume compressing the resilient element to such a degree that the resilient element is substantially no longer resilient.

4. The hand held machine of claim 2, wherein the volume of the spacing is continuously adjustable.

5. The hand held machine of claim 3, wherein the volume of the spacing is continuously adjustable.

6. The hand held machine of claim 2, wherein the spacing is defined between the housing, the front bearing, and the adjustment mechanism, and wherein the adjustment mechanism is arranged adjacent to the resilient element, and is movable in order to achieve adjustment of the spacing volume, and thereby adjustment of the resilience of the resilient element.

7. The hand held machine of claim 3, wherein the spacing is defined between the housing, the front bearing, and the adjustment mechanism, and wherein the adjustment mechanism is arranged adjacent to the resilient element, and is movable in order to achieve adjustment of the spacing volume, and thereby adjustment of the resilience of the resilient element.

8. The hand held machine of claim 4, wherein the spacing is defined between the housing, the front bearing, and the adjustment mechanism, and wherein the adjustment mechanism is arranged adjacent to the resilient element, and is movable in order to achieve adjustment of the spacing volume, and thereby adjustment of the resilience of the resilient element.

9. The hand held machine of claim 2, wherein the actuator is accessible from outside of the housing.

10. The hand held machine of claim 3, wherein the actuator is accessible from outside of the housing.

11. The hand held machine of claim 4, wherein the actuator is accessible from outside of the housing.

12. The hand held machine of claim 6, wherein the actuator is accessible from outside of the housing.

13. The hand held machine of claim 7, wherein the actuator is accessible from outside of the housing.

14. The hand held machine of claim 8, wherein the actuator is accessible from outside of the housing.

15. The hand held machine of claim 9, wherein the rotatable actuator comprises a rotatable ring which can be rotated between the first end position and the second end position.

16. The hand held machine of claim 10, wherein the rotatable actuator comprises a rotatable ring which can be rotated between the first end position and the second end position.

17. The hand held machine of claim 15, wherein the actuator comprises a cam having an edge with a cam curvature, which cam curvature interacts with a cam follower, which causes a displacement of the compressing element so as to increase or decrease the volume of the spacing.

18. The hand held machine of claim 16, wherein the actuator comprises a cam having an edge with a cam curvature, which cam curvature interacts with a cam follower, which causes a displacement of the compressing element so as to increase or decrease the volume of the spacing.

19. The hand held machine of claim 15, wherein axial movement of the compressing element is achieved by rotating a member provided with threads which is engaged by corresponding threads on the housing.

20. The hand held machine of claim 16, wherein axial movement of the compressing element is achieved by rotating a member provided with threads which is engaged by corresponding threads on the housing.

* * * * *